US007063434B2

(12) United States Patent
Wu

(10) Patent No.: US 7,063,434 B2
(45) Date of Patent: Jun. 20, 2006

(54) UMBRELLA GRIP ATTACHED WITH A LIGHT SOURCE

(76) Inventor: Hsien-Sao Wu, 12F, No. 24, Jilin Rd., Taipei City (TW)

( * ) Notice: Subject to any disclaimer, the term of this patent is extended or adjusted under 35 U.S.C. 154(b) by 0 days.

(21) Appl. No.: 10/920,296

(22) Filed: Aug. 18, 2004

(65) Prior Publication Data

US 2006/0039133 A1 Feb. 23, 2006

(51) Int. Cl.
*A45B 3/02* (2006.01)
*A63B 15/02* (2006.01)

(52) U.S. Cl. ..... 362/102; 362/800; 362/205; 362/208; 362/251

(58) Field of Classification Search ..... 362/102, 362/800, 190, 205, 208, 235, 251; 135/98, 135/16, 33.7, 15.1, 910
See application file for complete search history.

(56) References Cited

U.S. PATENT DOCUMENTS 6,089,727 A * 7/2000 Wu ..... 362/102

FOREIGN PATENT DOCUMENTS

GB 2224931 A * 5/1990

* cited by examiner

*Primary Examiner*—Sandra O'Shea
*Assistant Examiner*—Sharon Payne
(74) *Attorney, Agent, or Firm*—Troxell Law Office, PLLC

(57) ABSTRACT

A light source for an umbrella directly attached to its grip is set forth herein, a light source housing containing a light source, a battery unit, and a light source is engaged to the bottom of the umbrella grip. The battery power is directly supplied to the light source without using the electrical wiring. LED(s), or other high intensity lamps may be employed as the light source. The front portion of the light source housing is formed into a sloped surface serving as a refractor to conduct the light beam downwards and distribute it on the ground under the umbrella so as to assist the umbrella carrier walking at a dark, rainy night securely without the worry of a possible traffic accident.

4 Claims, 4 Drawing Sheets

UMBRELLA GRIP ATTACHED WITH A LIGHT SOURCE

BACKGROUND OF THE INVENTION

1. Field of the Invention

The present invention related to an umbrella grip attached with a light source, in particular, a battery energized light source attached beneath the umbrella grip which is used to illuminate the ground under the umbrella without the need of electric wiring in the umbrella.

2. Description of the Prior Art

In order to assure the pedestrian's traffic security when walking with an umbrella in a rainy night, use of an illuminated umbrella is indeed a good solution. For this, there have been two styles of illuminated umbrella prevailing on the market. One is installing a battery unit in the umbrella grip as a power supply to turn on a lamp equipped somewhere in the transparent umbrella back bone so as to perform a warning effect in the dark, rainy night, on the other hand the battery unit is in stalled in the grip, and an ornamental lamp is provided on top of the back bone. Both styles of illuminated umbrellas require the electric conductor to interconnect the battery unit and the lamp for supplying the battery power to the lamp. The light source attached to an umbrella in such manners is disadvantageous that the lamp fails to work in the case the electric conductor laid in the umbrella back bone is disconnected by some accident, besides, such complicated installation cause assembly of an illuminated umbrella cost and time wasting, and light intensity is often practically insufficient if an ordinary miniature incandescent bulb is used.

For these defects noticeable on the prior art, an improvement is seriously required.

The inventor has dedicated great efforts for years to studying and improving these defects and come up with a novel umbrella grip attached with a light source as provided in this invention to eliminate the defects mentioned above.

SUMMARY OF THE INVENTION

Accordingly, the main object of the present invention is to provide an umbrella grip attached with a light source in switch both the power and light source are combined in a housing which is attached to the umbrella grip so as to eliminate the need of electric wiring.

Another object of the present invention is to provide an umbrella grip attached with a light source in which the housing of the light source is provided with a sloped surface so as to serve as a refractor to conduct and distribute the light beam on the ground under the umbrella.

To achieve the aforementioned objects, the present invention provides a housing for lighting source attached to the bottom of the grip formed at the lower end of the umbrella back bone. The front portion of the housing is formed into a sloped surface serving as a refractor with a transparent window where a high intensity lighting element is installed inside such that the light beam is conducted down and distributed on the ground under to umbrella. A battery box is sandwiched and concealed between the umbrella grip and the housing with a battery unit set in it serving as power supply to the lighting element. With this structure, the electric wiring is no more necessary therefore resulting in saving the production cost and simplifying the assembly of the umbrella attached with a light source according to the present invention.

These features and advantages of the present invention will be fully understood and appreciated from the following detailed description of the accompanying Drawings.

DETAILED DESCRIPTION OF THE PREFERRED EMBODIMENT

Figure 1:
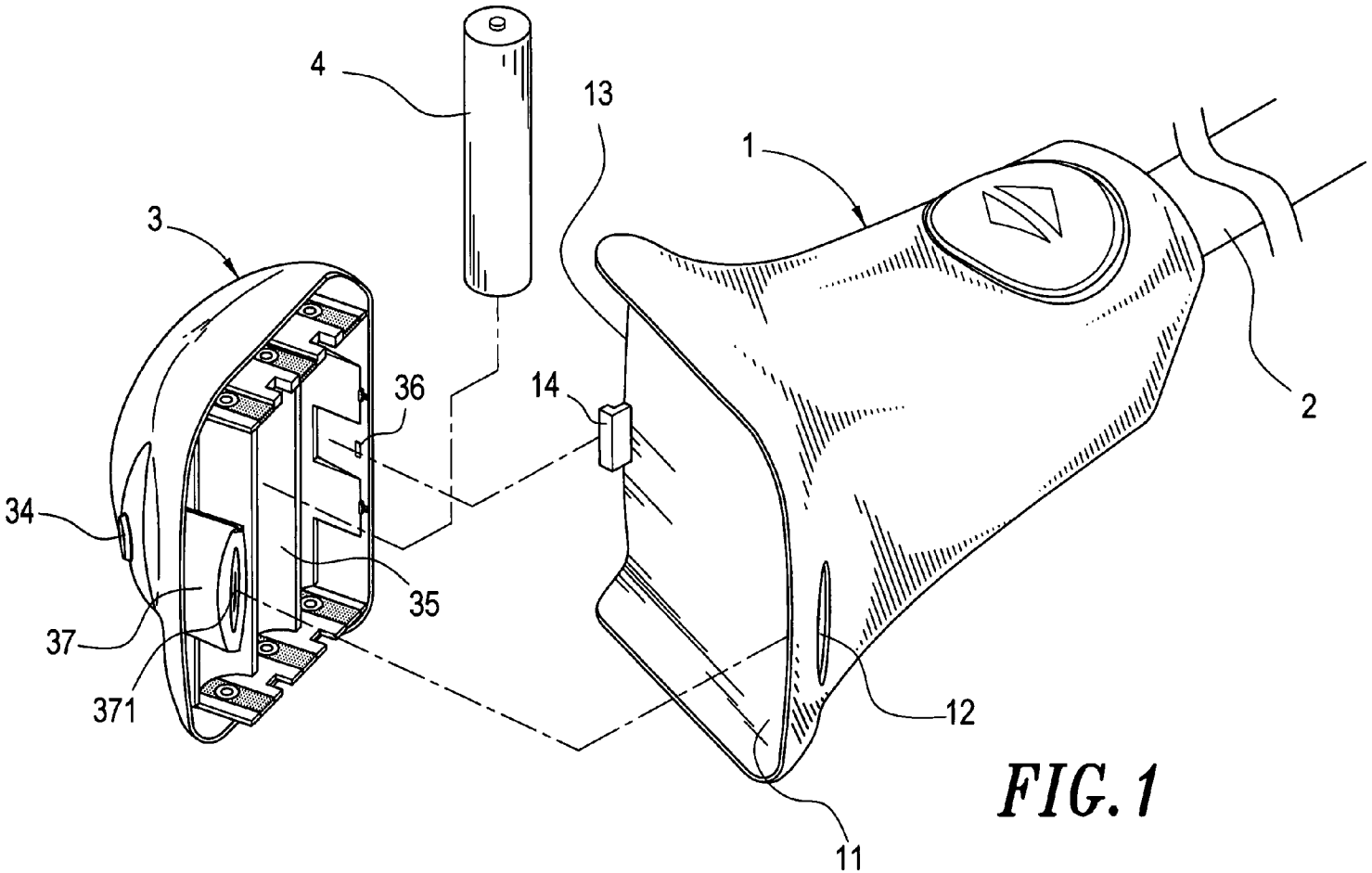
FIG. 1 is an exploded schematic view of the umbrella grip with its attached light source according to the present invention.
Figure 2:
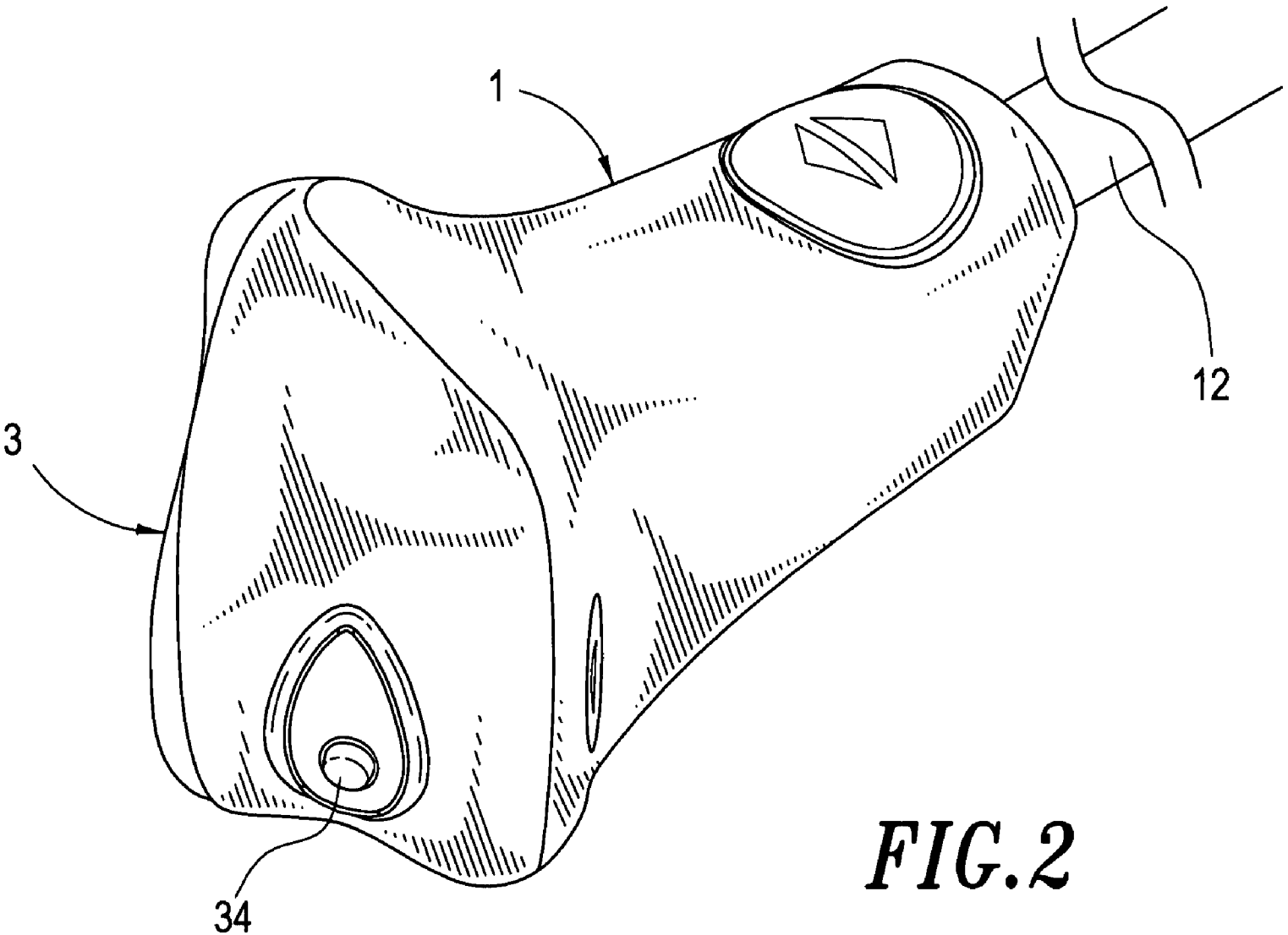
FIG. 2 is a perspective view of the umbrella grip with its attached light source according to the present invention.
Figure 3:
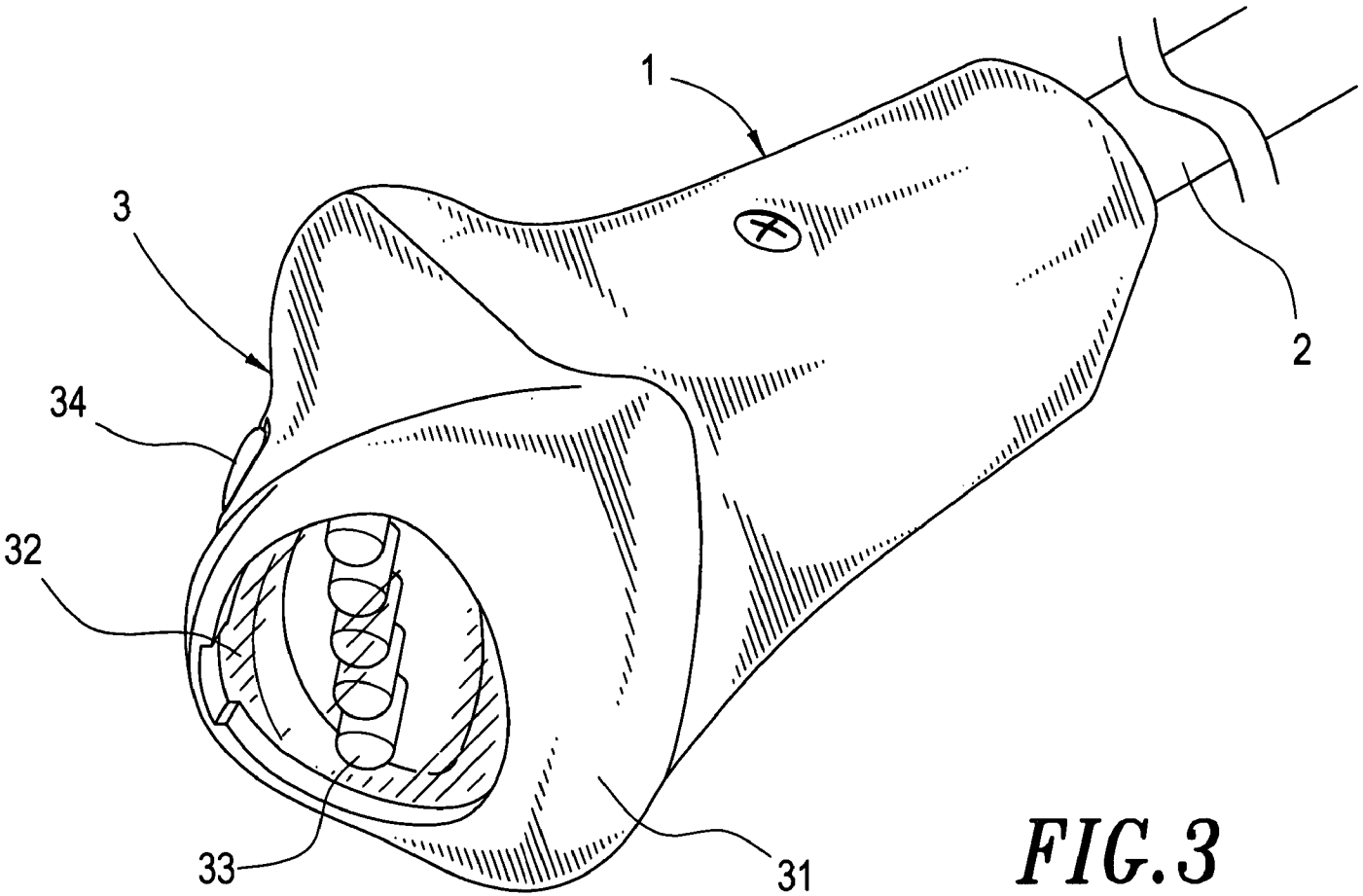
FIG. 3 is a perspective view of the umbrella grip with its attached light source observed from another angle.

Referring to FIG. 1 through FIG. 3, the umbrella grip attached with a light source is essentially composed of an umbrella grip 1 and a light source housing 3.

The umbrella grip 1 is installed at the lower end of an umbrella back bone 2. A chamber 11 formed at the bottom of the grip 1 is provided with a slot 12 at its one side and a port 13 left open at the opposite side, and an approximately 1 shaped hasp 14 is protruded from the center of the port 13.

The delta shaped housing 3 has a sloped surface 31 with a transparent window 32 formed at its front portion. A high intensity light source 33, or the equivalents is installed in the window 32. A switch 34 is installed at the rear portion of the housing 3 to control on-off of the power supply to the light source 33. A battery unit 4 which serves as a power source of the light source 33, is equipped in a battery box 35 formed at the top portion of the housing 3 and having a stopper 36 provided at its front wall surface and a spring buckle 37 associated with its snap catch 371 above, is provided at the rear side of the battery box 35.

With this structure, when the housing 3 is engaged to the bottom face of the grip 1 with its top surface, the battery unit 4 in the battery box 35 is covered by the chamber 11 at the bottom of the grip 1. The port 13 is then closed by engaging the hasp 14 with the stopper 36 and consequently the housing 3 can be firmly engaged to the grip 1 at its bottom by pressing the snap catch 371 so as to engage the spring buckle 37 with the slot 12 thereby shutting the slot 12. When it is desired to detach the housing 3, it is only necessary to press the snap catch 371 protruded out of the slot 12 downwards for releasing the spring buckle 37 from the slot 12 so as to install or replace the battery unit 4.

Figure 4:
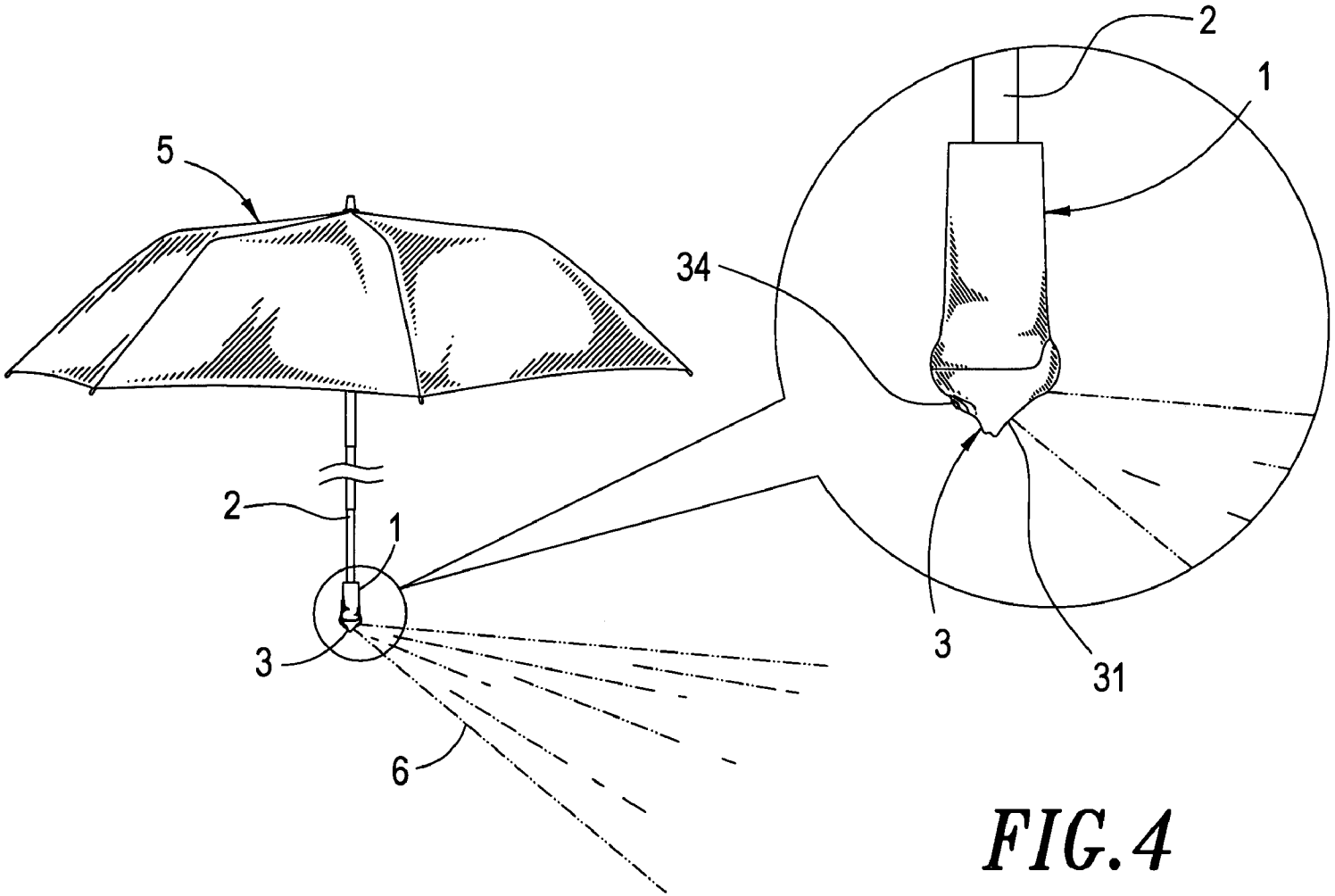
FIG. 4 is an illustrative view demonstrating how the umbrella light source of the present invention is put into practice.

When it is to use the umbrella 5 in a rainy dark night, reference can be made to FIG. 4 which demonstrates how the light source of the umbrella 5 is put into practice. It is already understood that the sloped refractor surface 31 formed at the front portion of the housing 3 is always directed towards the ground when the umbrella 5 is held upright by the user. At this moment the light source 33 is turned on by switching on the switch 34, the light beam emitted from the light source 33 is outputted from the transparent window 32 and then conducted down and distributed on the ground under the umbrella 5 by the refractor effect of the sloped surface 31 of the light source housing 3. In this manner, the pedestrian carrying with the umbrella 5 of the present invention in a dark rainy night is capable of walking securely with the aid of well illuminated ground around his/her foot steps without the fear of encountering a traffic accident or carelessly tumbling down by possible obstacles.

It emerges from the above description that the light source attached to the umbrella grip disclosed by the present invention has several noteworthy advantages, namely:

1. That the direct attachment of the light source housing to the umbrella grip causes it possible to eliminate the electric wiring to interconnect the battery unit and the light source that contributes to simplify production process and curtail the product cost.

2. That the sloped surface formed at the front portion of the light source housing serves as a refractor to conduct the light beam down and distribute on the ground for illuminating the ground under the umbrella so as to assist the umbrella user to walk securely in the dark rainy night.

Many changes and modifications in the above described embodiment of the invention can, of course, be carried out without departing from the scope thereof. Accordingly, to promote the progress in science and the useful arts, the invention is disclosed and is intended to be limited only by the scope of the appended claim.

What is claimed is:

1. An umbrella grip attached with a light source comprising:

an umbrella grip engaged to the bottom of an umbrella back bone;

a light source housing whose front portion being formed into a sloped surface provided with a transparent window to accommodate a high intensity light source therein, while a switch being provided at the rear portion of said light source housing, a top portion of said light source housing being formed into a battery box;

wherein, the top surface of said light source housing is engaged to the bottom face of said umbrella grip so as to face the sloped surface of said light source housing towards the ground thereby conducting the light beam outputted from said light source downwards and distributing it on the ground, wherein a chamber formed at the bottom of said umbrella grip is provided with a slot at a first side thereof and a port left open at a second side opposite the first side, and an L-shaped hasp protruding from a center of said port, said battery box formed at the top portion of said light source housing has a stopper at a front wall surface and a spring buckle associated with a snap catch is provided at a rear side of said battery box, said light source housing is firmly engaged with said umbrella grip by pressing said snap catch to engage said spring buckle with said slot, and closing said port by engaging said hasp with said stopper.

2. The umbrella grip of claim 1, wherein said light source is selected from a group consisting of LED(s) and high intensity lamps.

3. The umbrella grip of claim 1, wherein said switch provided at the rear portion of said light source housing is for switching a power supply to said light source.

4. The umbrella grip of claim 1, wherein said battery unit is used as a power source for said light source.

* * * * *